US005353505A

United States Patent [19]

Okada

[11] Patent Number: 5,353,505

[45] Date of Patent: Oct. 11, 1994

[54] GRIP SCISSORS

[75] Inventor: Hidekazu Okada, Osaka, Japan

[73] Assignee: Clover Mfg. Co., Ltd., Osaka, Japan

[21] Appl. No.: 112,781

[22] Filed: Aug. 12, 1993

Related U.S. Application Data

[63] Continuation of Ser. No. 967,116, Oct. 27, 1992, abandoned.

[30] Foreign Application Priority Data

Aug. 7, 1992 [JP] Japan ..... 4-055740[U]
Aug. 7, 1992 [JP] Japan ..... 4-055741[U]

[51] Int. Cl.[5] ..... B26B 13/18

[52] U.S. Cl. ..... 30/253; 30/236; 30/331

[58] Field of Search ..... 30/234, 235, 236, 244, 30/253, 329, 331

[56] References Cited

U.S. PATENT DOCUMENTS 98,840 1/1870 Barnard ..... 30/236
541,862 7/1895 Lohlein ..... 30/236
654,008 7/1900 Kirkland ..... 30/253
3,548,496 12/1970 Van Hook ..... 30/253
3,608,196 9/1971 Wiss ..... 30/253
3,972,333 8/1976 Leveen ..... 30/234
4,092,776 6/1978 Ferguson ..... 30/253

FOREIGN PATENT DOCUMENTS 0002515 6/1979 European Pat. Off. .

*Primary Examiner*—Richard K. Seidel
*Assistant Examiner*—Hwei-Siu Payer
*Attorney, Agent, or Firm*—William H. Eilberg

[57] ABSTRACT

A pair of grip scissors comprises a generally U-shaped spring member integrally made of a resin and a pair of blade members attached to the respective free ends of the spring member. The respective free ends of the spring member are provided with an opposed pair of stoppers bulging toward each other. The respective stoppers come into stopping abutment with each other when the spring member is manually gripped. Each stopper has a mounting side face directed away from the mounting side face of the other stopper, and each blade member has a connecting portion attached laterally to the mounting side face of the corresponding stopper.

7 Claims, 4 Drawing Sheets

GRIP SCISSORS

This application is a continuation of application Ser. No. 07/967,116, filed Oct. 27, 1992, now abandoned.

BACKGROUND OF THE INVENTION

1. Field of the Invention

The present invention relates to a grip scissors commonly used for thread cutting purposes.

2. Description of the Prior Art

Grip scissors (also known as thread-cutting scissors) have been widely used in Japanese kimono making and other sewing jobs. Traditionally, a pair of grip scissors comprises a generally U-shaped spring portion which is manually grasped, and a pair of blade portions formed integrally with the respective free ends of the U-shaped spring portion. Each of the blade portions has a cutting edge which comes into sliding contact with the cutting edge of the other blade portion.

Generally, such a pair of grip scissors is made by forging a steel strip to have a U-shaped spring portion and a pair of blade portions. Then, the blade portions are ground to have a pair of cutting edges.

In a natural state, the blade portions partially overlap each other, and the respective cutting edges form an acute angle therebetween. For cutting, the U-shaped spring portion is manually gripped to swing the blade portions to reduce the angle between the respective cutting edges while maintaining sliding contact therebetween. When the U-shaped spring portion is freed of the manual gripping force, the blade portions return to their original positions under the elastic restoring force of the spring portion.

A problem with the one-piece grip scissors described above is that when the spring portion is gripped too strongly, the cutting edge of each blade portion tends to project beyond the back edge of the other blade portion due to over-swing movement of the respective blade portions. Thus, the user's fingers may be injured by the thus projecting cutting edge during a cutting operation.

It is conceivable to eliminate this problem by providing, on the spring portion, an opposed pair of stoppers which come into stopping contact with each other for preventing over-swing movement of the blade portions. However, since the spring portion is made of steel, it is rather difficult to integrally form such a pair of stoppers on the spring portion.

Another problem of the one-piece grip scissors is related to heat treatment of the blade portions. Specifically, the blade portions need be thermally hardened by quenching in order to provide a long lasting cutting ability. However, if the spring portion is integral with the blade portions, the thermal treatment (hardening by quenching) of the blade portions also affect the spring portion. Thus, in the absence of strict temperature control, the spring portion is unexpectedly hardened, thus failing to provide an intended spring performance. Further, the hardened spring portion lacks toughness and fatigue strength, so that cracks may be easily formed after repeated use.

A further problem of the one-piece grip scissors resides in the difficulty of re-grinding the blade portions. Obviously, the cutting edges will wear and lose sharpness after repeated use, so that they must be re-ground from time to time. However, with the one-piece grip scissors, since the blade portions are not separable from the spring portion, the blade portions must be inconveniently separated from each other against the elastic force of the spring portion before re-grinding.

In an attempt to solve these problems, the Japanese Utility Model Laid-open No. 63-189172 proposes a pair of grip scissors which comprises a U-shaped spring member made of resin, and a pair of metallic blade members separate from but connected to the spring member. Specifically, each free end of the U-shaped spring member is formed with an axial receptacle bore, whereas the corresponding blade member has a connecting portion inserted in the axial receptacle bore.

Obviously, the separate type grip scissors described above can eliminate the problems attendant with the one-piece grip scissors. However, the separate type grip scissors still have the following problems.

First, since the depth of the axial receptacle bore must be relative large, it is difficult to realize strict dimensional accuracy of the receptacle bore at the time of molding the resinous spring member. Thus, when the connecting portion of the corresponding blade member is inserted in the receptacle bore, the blade member may deviate slightly from an exact position relative to the other blade member. As a result, positional readjustment of the blade member may be additionally necessary, consequently increasing the manufacturing cost.

Secondly, in order to prevent unexpected removal of each blade member, it is necessary to fix the blade member by pins or screws inserted perpendicularly to the blade member. On the other hand, the blade member itself must be inserted axially into the corresponding receptacle bore. Thus, assembly of the blade member must be performed in two different directions which are perpendicular to each other, and a complicated machine must be used for automation of assembly.

In the third place, it is inevitable that the cutting edge of one blade member is slid against that of the other blade member under the elastic force of the spring member at the time of assembly because the respective blade members must be axially inserted into the corresponding receptable bores. Thus, the cutting edge is likely to be damaged or chipped during the assembling operation. Indeed, this problem has been one of the hurdles which must be cleared for realizing automation of assembly.

SUMMARY OF THE INVENTION

It is, therefore, an object of the present invention to provide a pair of grip scissors which can be assembled easily to enable automation, thereby increasing the production efficiency to reduce the production cost.

According to the present invention, there is provided a pair of grip scissors comprising: a generally U-shaped spring member integrally made of a resin, the spring member having a web portion and an opposed pair of grip portions extending from the web portion, each grip portion having a free end; and a pair of metallic blade members respectively having cutting edges which come into mutual sliding contact, each blade member having a connecting portion attached to the free end of a corresponding grip portion; wherein the respective free ends of the grip portions are provided with an opposed pair of stoppers bulging toward each other, the respective stoppers coming into stopping abutment with each other when the respective grip portions are elastically brought closer to each other; each stopper has a mounting side face directed away from the mounting side face of the other stopper; and the connecting portion of said each blade member is attached laterally to the mounting side face of a corresponding stopper by screwing.

Other objects, features and advantages of the present invention will become apparent from the following description of the preferred embodiments given with reference to the accompanying drawings.

DETAILED DESCRIPTION OF THE PREFERRED EMBODIMENTS

The present invention will now be described in more specific detail referring to the accompanying drawings.

FIGS. 1 through 5 show a first embodiment of the present invention.

Figure 1:
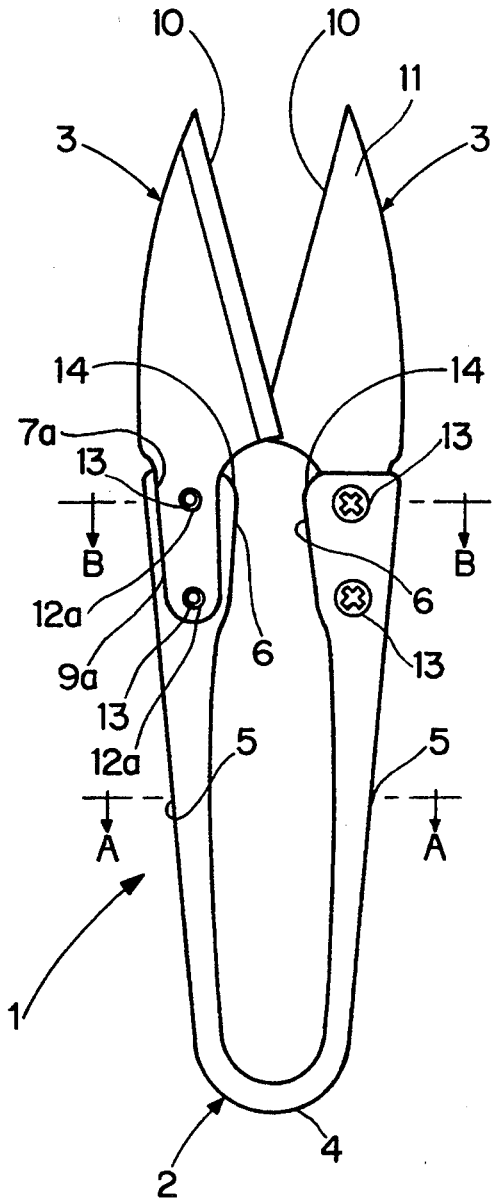
FIG. 1 is a side view showing a pair of grip scissors according to a first embodiment of the present invention.
Figure 2:
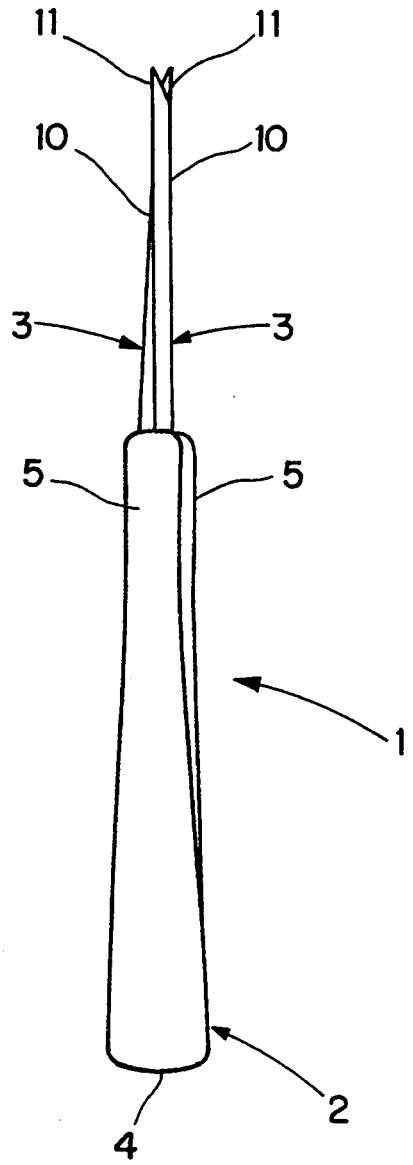
FIG. 2 is a plan view of the same.
Figure 3:
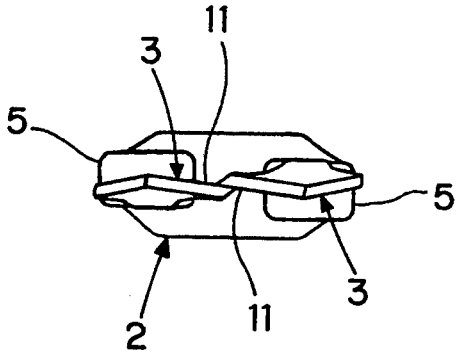
FIG. 3 is a front view of the same.
Figure 4:
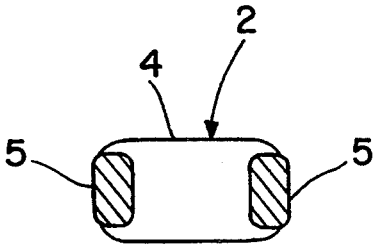
FIG. 4 is a transverse sectional view taken on the lines A—A of FIG. 1.

As will be understood from FIGS. 1 and 2, a pair of grip scissors 1 according to the present invention comprises a generally U-shaped spring member 2 made of a resin, and a pair of metal blade members 3 each attached to respective free end portions of the spring member 2.

The spring member 2 comprises a web portion 4, and an opposed pair of grip portions 5 extending from the web portion 4. In this embodiment, the entire spring member 2 is integrally made of a polyamide resin which is reinforced with glass fibers.

Figure 5:
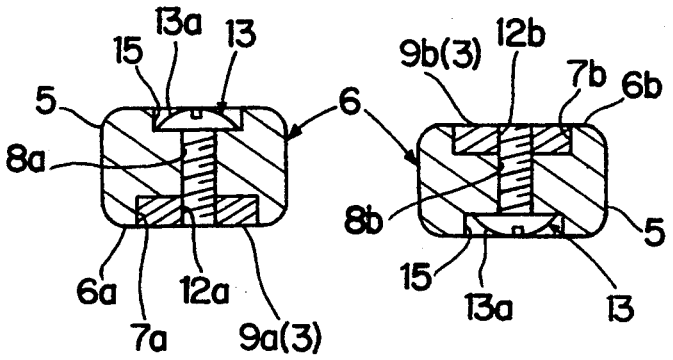
FIG. 5 is a transverse sectional end view taken on the lines B—B of FIG. 1.

The grip portions 5 are integrally formed, at their free ends, with respective stoppers 6 bulging toward each other. As shown in FIG. 1, the end stoppers 6 increase their width toward their respective free end extremities. Also, as shown in FIGS. 1 and 5, the stoppers 6 have respective mounting faces 6*a*, 6*b* directed away from each other. These mounting faces 6*a*, 6*b* are formed with respective positioning recesses 7*a*, 7*b* for connecting the blade members 3. The positioning recesses 7*a*, 7*b* are provided, on their bottom surfaces, with two perforations (through-holes) 8*a*, 8*b* for screw setting purposes.

The blade members 3 have respective connecting portions 9*a*, 9*b* and cutting edges 10. The pair of cutting edges 10 are arranged at an acute angle.

The blade members 3 have respective inner blade faces 11 which partially overlap each other in the same manner as in conventional grip scissors. The connecting portions 9*a*, 9*b* are respectively provided with two threaded holes 12*a*, 12*b* to receive set screws 13 coming through the respective perforations 8*a*, 8*b* of the stoppers 6.

As shown in FIG. 5, the present embodiment uses an arrangement in which the pair of positioning recesses 7*a*, 7*b* are provided on the respective mounting faces 6*a*, 6*b* which are directed away from each other. In these recesses 7*a*, 7*b*, there are fitted the corresponding connecting portions 9*a*, 9*b* of the blade members 3. Preferably, the recesses 7*a*, 7*b* have a depth which is substantially equal to the thickness of the blade members 3, so that the outwardly directed surfaces of the blade members become flush with the respective mounting faces 6*a*, 6*b*. Such an arrangement provides an improved appearance.

For fixing the blade members 3, the set screws 13 are inserted through the perforations 8*a*, 8*b* from the opposite side of the respective mounting faces 6*a*, 6*b* into engagement with the respective threaded holes 12*a*, 12*b*. Thus, the blade members 3 are attached to the spring member 2 in a manner such that each stopper 6 is sandwiched between the corresponding connecting portion 9*a* (or 9*b*) and the corresponding screw heads 13*a*.

As also shown in FIG. 5, the head 13*a* of each set screw 13 is completely received in a corresponding recess 15 formed in the corresponding end stopper 6 on the side thereof opposite to the corresponding positioning recess 7*a* (or 7*b*). Thanks to this arrangement, the presence of the set screw 13 does not deteriorate the appearance.

As appreciated from FIG. 1, the pair of blade members 3 together with the connecting portions 9*a*, 9*b* are shaped identically. Thus, each of the blade members 3 may be mounted on either one of the end stoppers 6.

As also appreciated from FIG. 1, each of the threaded holes 12*a*, 12*b* may be preferably offset from a central longitudinal axis of the corresponding connecting portion 9*a* (or 9*b*). This arrangement completely eliminates the likelihood that each of the blade members 3 is erroneously mounted upside down.

With the arrangement described above, the spring member 2 and the blade members 3 can be separately manufactured. Therefore, the blade members 3 may be thermally hardened by quenching before mounting thereof onto the spring member 2. Thus, it is possible to prevent elasticity deterioration and crack formation at the U-shaped web portion 4. Indeed, such problems were encountered with respect to conventional one-piece grip scissors. Furthermore, it is easier to uniformly heat-treat the entirety of each blade member 3 than conventionally was, so that the blade member is less liable to quality variation and quench distortion.

As described before, the spring member 2 is made of glass fiber reinforced polyamide resin. This material has a significantly superior fatigue strength to the conventional material, i.e. steel, and therefore, can remarkably improve the life of the spring member. In addition, the specific weight of this resin is smaller than that of steel, hence contributing greatly to an overall weight reduction.

When the spring member 2 is in its natural state, the respective end stoppers 6 of the grip portions 5 are opposed to each other with a gap formed between their bulge tops 14. These bulge tops 14 come into contact with each other when the spring member 2 is manually gripped. The gap between the bulge tops 14 is preferably determined so that the cutting edge 10 of one blade member 3 does not project beyond the back edge of the other blade member when the respective bulge tops 14 are brought into mutual contact. Such an arrangement eliminates the likelihood that the use's fingers are accidentally injured during a cutting operation.

Further, according to the arrangement of the above-described embodiment, the respective mounting faces 6*a*, 6*b* of the end stoppers 6 are directed away from each other, and the positioning recesses 7*a*, 7*b* are formed respectively in these mounting faces 6a, 6b. Thus, the connecting portions 9a, 9b of the respective blade members 3 can be laterally fitted in the positioning recesses 7a, 7b and fixed in place simply by screwing. This manner of assembly is very simple and requires no complicated machine for automation. Obviously, the use of the positioning recesses 7a, 7b provides easy but accurate positioning of the blade members 3, which fact additionally facilitates automation of assembly.

Still further, due to the capability of laterally mounting the blade members 3 relative to the spring member 2, the blade members 3 need not be elastically slid with each other at the time of assembly. Thus, it is possible to greatly reduce the risk of damaging the cutting edges 10 during automated assembly.

Moreover, the use of the set screws 13 enables removal of the respective blade members 3. Such removal facilitates separate re-grinding of the blade members 3 for restoring the cutting ability after repeated use.

Figure 6:
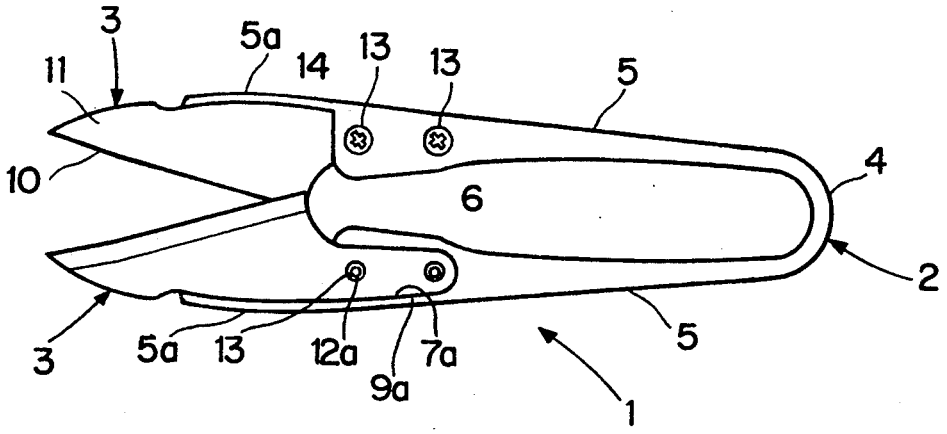
FIG. 6 is a side view showing a pair of grip scissors according to a second embodiment of the present invention.
Figure 7:
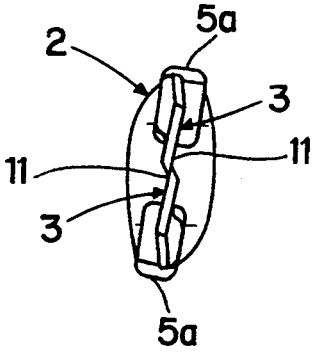
FIG. 7 is a front view of the same.
Figure 8:
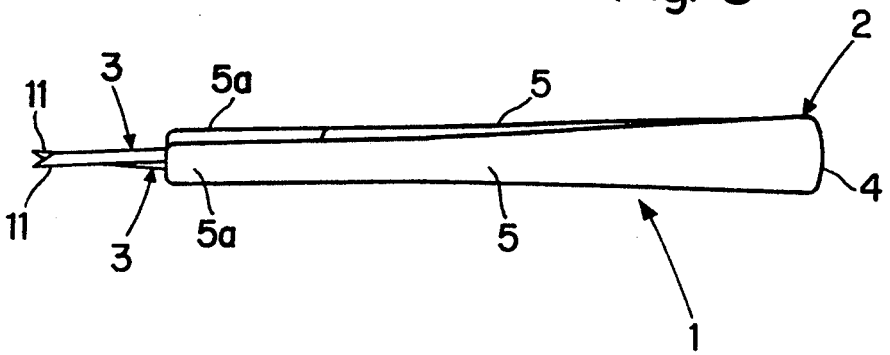
FIG. 8 is a plan view of the same.

FIGS. 6 through 8 show a pair of grip scissors according to a second embodiment of the present invention.

The second embodiment differs from the first embodiment only in that each end stopper 6 is integrally formed with a protective guide 5a extending from the end stopper 6 for covering the back edge of a corresponding blade member 3. Since the protective guide 5a prevents the user's fingers (including the thumb) from coming into direct contact with the blade member 3 which is made of metal, it is possible for the user to exert a greater cutting force than is possible with the pair of grip scissors of the first embodiment.

The scope of the present invention should not be limited to the specific embodiments described hereinabove.

For instance, the spring member 2 may be made of a carbon fiber reinforced resin or other type of resin instead of a glass fiber reinforced polyamide resin, whereas each of the bulging end stoppers 6 may be made to have a bulge top at an intermediate position thereof. Further, the holes 12a, 12b of the respective blade connecting portions 9a, 9b may be non-threaded while the perforation 8a, 8b of the respective end stoppers 6 may be threaded for direct engagement with the respective set screws 13.

Still further, the respective mounting faces 6a, 6b of the end stoppers 6 may be dispensed with the positioning recesses 7a, 7b.

I claim:

1. A pair of grip scissors comprising:

a generally U-shaped spring member integrally made of a resin, the spring member having a web portion and an opposed pair of grip portions extending from the web portion, each grip portion having a free end; and a pair of metallic blade members each having a cutting edge and an inner blade face, said each blade member further having a connecting portion attached to the free end of said each grip portion, the inner blade faces of the respective blade members being held in contact with each other even in a natural state of the spring member;

wherein the free end of said each grip portion has an exterior mounting side face and an opposing exterior non-mounting side face; and the connecting portion of said each blade member is attached laterally to the exterior mounting side face of said each grip portion with the inner blade face of said each blade member directed toward the exterior non-mounting side face of each said grip portion, and wherein the connecting portion of each blade member is in direct contact with the exterior mounting side face of said each grip portion.

2. The pair of grip scissors according to claim 1, wherein the mounting side face of said each grip portion is provided with a positioning recess shaped to receive snugly the connecting portion of said each blade member.

3. The pair of grip scissors according to claim 2, wherein the positioning recess of said each grip portion has a depth substantially equal to the thickness of the connecting portion of said each blade member

4. The pair of grip scissors according to claim 1, wherein the free end of said each grip portion is integrally formed with a protective extension which covers a back edge of said each blade member.

5. The pair of grip scissors according to claim 1, wherein the free end of said each grip portion is integrally formed with a stopper, the stoppers of the respective grip portions bulging toward each other for coming into mutual stopping abutment.

6. The pair of grip scissors according to claim 5, wherein the stoppers of the respective grip portions bulge to such an extent that the cutting edge of said each blade member is prevented from projecting beyond a back edge of the other blade member when the respective stoppers come into stopping abutment.

7. The pair of grip scissors according to claim 1, wherein the spring member is made of a fiber-reinforced polyamide resin.

* * * * *